US007175245B2

(12) United States Patent
Sekiya et al.

(10) Patent No.: US 7,175,245 B2
(45) Date of Patent: Feb. 13, 2007

(54) INK-JET HEAD AND INK-JET TYPE RECORDING APPARATUS

(75) Inventors: Yasuhito Sekiya, Chiba (JP); Shinji Saeki, Chiba (JP)

(73) Assignee: SII Printek Inc. (JP)

( * ) Notice: Subject to any disclaimer, the term of this patent is extended or adjusted under 35 U.S.C. 154(b) by 221 days.

(21) Appl. No.: 10/867,867

(22) Filed: Jun. 15, 2004

(65) Prior Publication Data

US 2004/0263549 A1 Dec. 30, 2004

(30) Foreign Application Priority Data

Jun. 25, 2003 (JP) ..... 2003-181468

(51) Int. Cl.
*B41J 29/38* (2006.01)

(52) U.S. Cl. ..... 347/10; 347/68; 347/11

(58) Field of Classification Search ..... 347/68, 347/69, 70, 9, 10–11, 40–42
See application file for complete search history.

(56) References Cited

U.S. PATENT DOCUMENTS 4,992,808 A * 2/1991 Bartky et al. ..... 347/69
5,329,293 A 7/1994 Liker ..... 347/11
6,276,773 B1 * 8/2001 Takizawa ..... 347/10

FOREIGN PATENT DOCUMENTS

| | | |
|---|---|---|
| EP | 0788882 | 3/1998 |
| EP | 0827838 | 8/1999 |
| EP | 1000742 | 9/2000 |
| EP | 1080896 | 3/2001 |
| EP | 1319511 | 6/2003 |

* cited by examiner

*Primary Examiner*—Stephen Meier
*Assistant Examiner*—Lam Nguyen
(74) *Attorney, Agent, or Firm*—Adams & Wilks

(57) ABSTRACT

An ink-jet head has deformable ink chambers formed in a piezoelectric ceramic plate and communicating with nozzle openings for ejecting ink from the chambers in response to voltage drive waveforms applied to electrodes on side walls of the chambers. A drive waveform generator selectively applies to the electrodes a first drive waveform to eject an ink droplet from a nozzle opening or a second drive waveform for vibrating a meniscus of the ink to the extent that no ink droplet is ejected from the nozzle opening. By vibrating the ink meniscus, thickening of ink in the nozzle openings can be suppressed without a complicated voltage control.

8 Claims, 10 Drawing Sheets

INK-JET HEAD AND INK-JET TYPE RECORDING APPARATUS

BACKGROUND OF THE INVENTION

1. Field of the Invention

The present invention relates to an ink-jet type recording apparatus applied to, for example, a printer or a facsimile, and to a technique for preventing ink in a nozzle opening portion from thickening and drying with intent to stably eject an ink drop.

2. Description of the Related Art

Up to now, an ink-jet type recording apparatus has been known which records characters, images, etc. on a recording medium by using an ink-jet head having a plurality of nozzles for ejecting ink. In such an ink-jet type recording apparatus, the ink-jet head is provided in a head holder such that the nozzles of the ink-jet head are opposed to the recording medium, and the head holder is mounted on a carriage, and scanning is performed in a direction orthogonal to the direction in which the recording medium is conveyed.

FIG. 8 is a schematic exploded view of an example of a head tip of such an ink-jet head, and FIG. 9 is a sectional view of a main part thereof.

As shown in FIGS. 8 and 9, a plurality of chambers 102 are arranged side by side in a piezoelectric ceramic plate 101, the chambers 102 being separated from each other by side walls 103. One longitudinal end portion of each chamber 102 extends to one end surface of the piezoelectric ceramic plate 101, and the other end portion thereof does not extend to the other end surface. The depth of each chamber 102 gradually decreases along the length thereof. Longitudinally extending electrodes 105 for drive electric field application are formed on openingside surfaces of both side walls 103 of each chamber 102.

Further, a cover plate 107 is joined to the side of the piezoelectric ceramic plate 101 where the chambers 102 are open through the intermediation of an adhesive 109. The cover plate 107 has a common ink chamber 111 constituting a recess communicating with the shallow other end portions of the chambers 102 and an ink supply port 112 extending from the bottom of the common ink chamber 111 to the side opposite to the chambers 102.

Furthermore, a nozzle plate 115 is joined to the end surface of a joint unit of the piezoelectric ceramic plate 101 and the cover plate 107 where the chambers 102 are open, and nozzle openings 117 are formed at positions of the nozzle plate 115 opposed to the chambers 102.

Note that, a wiring substrate 120 is fixedly bonded to the surface of the piezoelectric ceramic plate 101 on the side opposite to the cover plate 107 and on the side opposite to the nozzle plate 115. A wiring 122 is formed on the wiring substrate 120, which is connected by the electrodes 105, bonding wires 121, etc., and a drive voltage can be applied to the electrodes 105 through the wiring 122.

In this head tip constructed as described above, the chambers 102 are filled with ink from the ink supply port 112. When a predetermined drive electric field is caused to act on both side walls 103 of the given chamber 102 through the electrodes 105, the side walls 103 undergo deformation and the volume of the chamber 102 temporarily changes, so that ink in the chamber 102 is ejected from the nozzle opening 117.

For example, when, as shown in FIG. 10, ink is to be ejected through the nozzle opening 117 corresponding to a chamber 102*a*, positive drive voltage is applied to electrodes 105*a* and 105*b* in the chamber 102*a*, and electrodes 105*c* and 105*d* respectively opposed thereto are grounded, by which a drive electric field directed to the chamber 102*a* is applied to side walls 103*a* and 103*b*. When this is orthogonal to the polarization direction of the piezoelectric ceramic plate 101, the side walls 103*a* and 103*b* are deformed toward the chamber 102*a* by the piezoelectric thickness slippage effect, and the volume of the chamber 102*a* decreases to cause an increase in pressure on the ink, thereby causing ink to be ejected through the nozzle opening 117.

In such an ink-jet head, the ink in the nozzle opening portion in which ejection operation is performed at frequent intervals hardly dries because new ink is successively supplied. However, when the ejection state of the ink is stopped or when non-ejection data is successively inputted to the same chamber, the ink in the nozzle opening portion is left to be exposed to the air, it dries and thickens. If the ink is ejected in this state, an ejection speed is reduced, the ink droplet flies off course, and clogging is caused.

Thus, there has been proposed that the operation for evacuating the thickened ink is performed at regular intervals by moving the head to the outside of a printing region to forcedly eject the ink or by sucking it in a state in which a cap is in contact with the nozzle plate side In the above-mentioned method of evacuating the thickened ink, the evacuation of the ink causes increased ink consumption and it is necessary to stop printing, so that a printing rate reduces. In order to solve this, there has been proposed a method in which the piezoelectric ceramic is driven to vibrate the meniscus at a voltage low enough to prevent ink ejection so that the thickened ink on the surface of the meniscus is agitated (for example, see Patent Document 1 and Patent Document 2).

[Patent Document 1]

JP 55-123476 A (page 5)

[Patent Document 1]

JP 57-61576 A (pages 1–2, FIG. 2)

However, in the above-mentioned method of vibrating the meniscus at a voltage low enough to keep from ink ejection, when the meniscus is vibrated on a nozzle in which the ink is not ejected in accordance with the specification of the recording data during printing operation, it is necessary to change a voltage applied to a nozzle according to whether or not the ejection is performed. Therefore, there is a problem in that voltage control and a driver circuit are complicated.

SUMMARY OF THE INVENTION

The present invention has been made in view of such circumstances. Therefore, an object of the present invention is to provide an ink-jet head and ink-jet type recording apparatus, in which the complicated voltage control is not required and the meniscus is vibrated to the extent to which the ejection is not performed on an arbitrary nozzle during a printing operation so that thickening of the ink in the nozzle opening portion can be suppressed and a nozzle in which the meniscus is vibrated can be easily specified.

To solve the above-mentioned problems, according to a first aspect of the present invention, there is provided an ink-jet head in which a plurality of chambers, each of which is communicated with a nozzle opening and filled with ink, are arranged side by side in a piezoelectric ceramic plate, electrodes are provided on both side walls of each of the chambers, and the ink is ejected by supplying a voltage drive waveform to the electrodes to generate a drive electric field in the side walls, the ink-jet head being characterized by including: drive waveform generating means for selecting any one of a first drive waveform for ejecting ink droplet from the nozzle opening and a second drive waveform for vibrating a meniscus to an extent to which the ink droplet is not ejected from the nozzle opening, based on recording data related to printing, which is ouputted from an external circuit, and outputting a voltage drive waveform to the electrodes.

According to a second aspect of the present invention, there is provided the ink-jet head according to the first aspect of the invention, characterized in that the drive waveform generating means selects one drive waveform from, the first drive waveform, the second drive waveform, and a third drive waveform by which the meniscus in the nozzle opening is not vibrated, based on the recording data, and outputs a voltage drive waveform to the electrodes.

According to a third aspect of the present invention, there is provided the ink-jet head according to the second aspect of the invention, characterized in that the recording data for each of the chamber has the amount of information equal to or larger than at least two bits, and one of the second drive waveform and the third drive waveform can be selected using one bit which is smaller than the amount of information.

According to a fourth aspect of the present invention, there is provided the ink-jet head according to the third aspect of the invention, characterized in that one of the second drive waveform and the third drive waveform can be selected using one bit of the recording data.

According to a fifth aspect of the present invention, there is provided the ink-jet head according to any one of the first to fourth aspects of the invention, characterized in that the second drive waveform has a voltage amplitude equal to the first drive waveform and a pulse width shorter than the first drive waveform.

According to a sixth aspect of the present invention, there is provided the ink-jet head according to any one of the first to fifth aspects of the invention, characterized in that the second drive waveform is supplied to the electrodes immediately before printing starts.

According to a seventh aspect of the present invention, there is provided the ink-jet head according to any one of the first to fifth aspects of the invention, further including a counter circuit that counts the number of ejection timing signals for controlling ink ejection from the nozzle, characterized in that the second drive waveform is supplied to the electrodes periodically every predetermined number of counts of the counter circuit.

According to an eighth aspect of the present invention, there is provided the ink-jet head according to the first or second aspect of the invention, characterized in that the drive waveform generating means includes a driver circuit that outputs a drive waveform to the electrodes, a counter circuit that counts the number of ejection timing signals for controlling ink ejection from the nozzle, and an OR circuit that computes a logical OR of the recording data related to printing, which is outputted from the external circuit and data outputted from the counter circuit and outputs a result to the driver circuit.

According to a ninth aspect of the present invention, there is provided the ink-jet head according to the first or second aspect of the invention, characterized in that the drive waveform generating means includes a driver circuit that outputs a drive waveform to the electrodes, printing start detection means for detecting whether or not a current time is immediately before printing starts, based on information from control means that outputs the recording data, and an OR circuit that computes a logical OR of the recording data outputted from the control means and data outputted from the printing start detection means and outputs a result to the driver circuit.

According to a tenth aspect of the present invention, there is provided an ink-jet type recording apparatus, characterized by including the ink-jet head according to any one of the first to ninth aspects of the invention.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PRESENT INVENTION

Hereinafter, the present invention will be described in detail with reference to embodiments.

(Embodiment 1)

Figure 1:
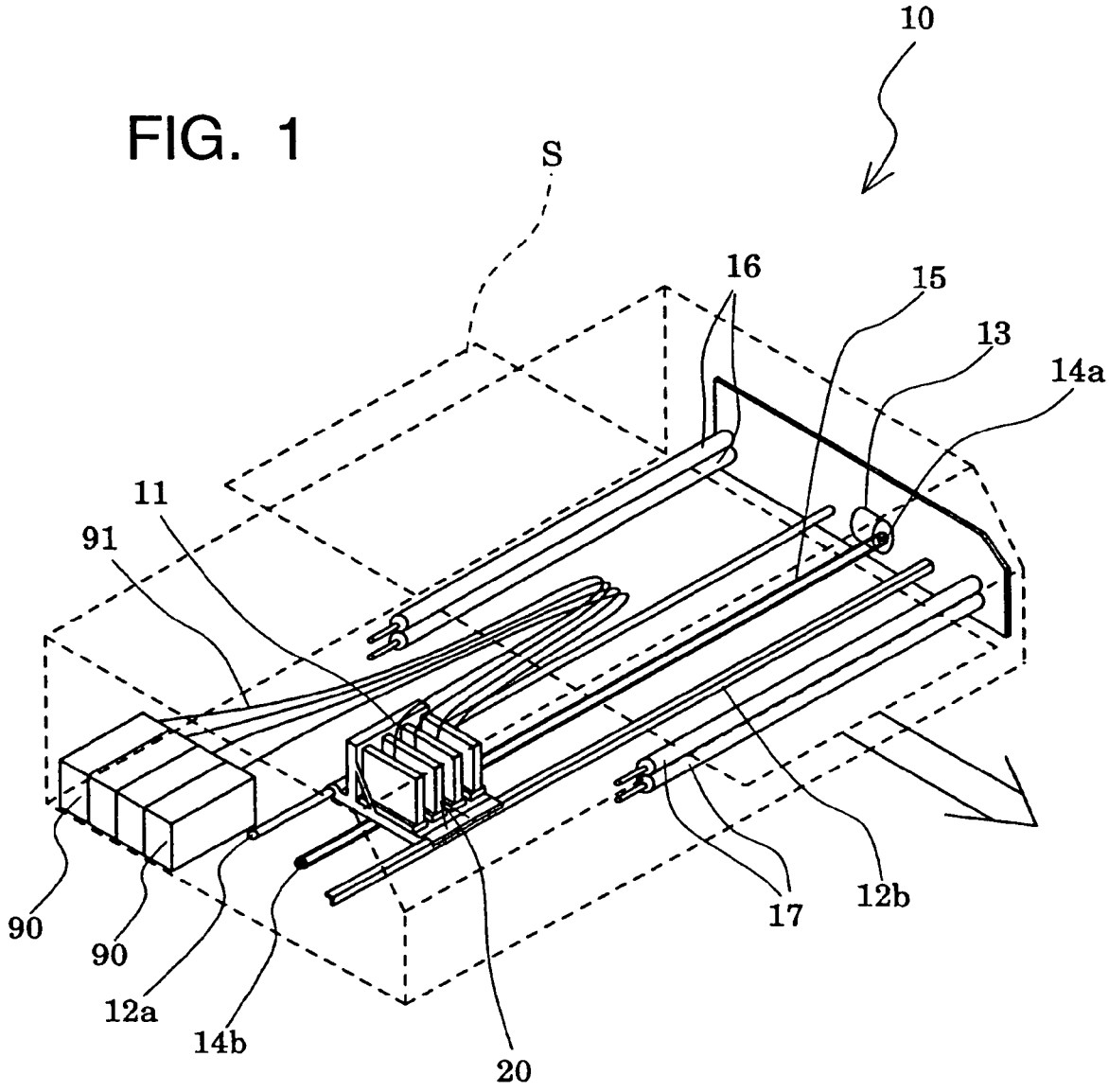
FIG. 1 is a schematic view showing an ink-jet type recording apparatus according to an Embodiment of the present invention.

FIG. 1 is a schematic perspective view showing an ink-jet type recording apparatus according to Embodiment 1 of the present invention.

As shown in FIG. 1, an ink-jet type recording apparatus 10 according to this Embodiment includes a plurality of ink-jet heads 20 provided for respective colors, a carriage 11 on which the plurality of ink-jet heads 20 are arranged in a main scanning direction and mounted, ink tanks 90 each of which is a part of ink containing means that supplies ink through an ink supply tube 91 made from a flexible tube. The carriage 11 is mounted so as to be movable on a pair of guide rails 12*a* and 12*b* in an axis direction. In addition, a drive motor 13 is provided on one end side of the guide rails 12*a* and 12*b*, so that drive force produced by the drive motor 13 is transmitted along a timing belt 15 which is looped between a pulley 14*a* connected with the drive motor 13 and a pulley 14*b* provided on the other side of the guide rails 12*a* and 12*b*.

Also, a pair of transport rollers 16 and 17 are provided along the guide rails 12*a* and 12*b* on both end portion sides of the carriage 11 in a direction orthogonal to its transport direction. The transport rollers 16 and 17 transport a recording medium S below the carriage 11 in the direction orthogonal to the transport direction of the carriage 11.

Then, while the recording medium S is fed by the transport rollers 16 and 17, the carriage 11 is scanned in an orthogonal direction to its feed direction, so that characters, images, and the like are recorded on the recording medium S by the ink-jet heads 20.

Note that each of the ink-jet heads 20 is a large type for ejecting single color ink. For example, in this Embodiment, four heads are arranged side by side and mounted on the carriage 11 corresponding to four colors of black (B), yellow (Y), magenta (M), and cyan (C).

Also, each of the ink tanks 90 which is filled with each color ink is provided at a position in which the movement of the carriage 11 in the main scanning direction and the movement of the recording medium S are not hindered and at a position which is lower than the nozzle opening of the ink-jet head 20 by a predetermined amount so as to provide a negative pressure into the ink-jet head 20.

Further, although described in detail later, an external circuit which is not shown and that transmits printing data and the like to respective driving circuits for the ink-jet heads 20 is provided in the ink-jet type recording apparatus 10.

Note that, in the ink-jet type recording apparatus 10, operation for removing deposited-ink by wiping nozzle plate surfaces of the ink-jet heads 20, so-called cleaning operation, is performed at predetermined timing such as a time of activation or a time before printing starts, or arbitrary timing.

Figure 2:
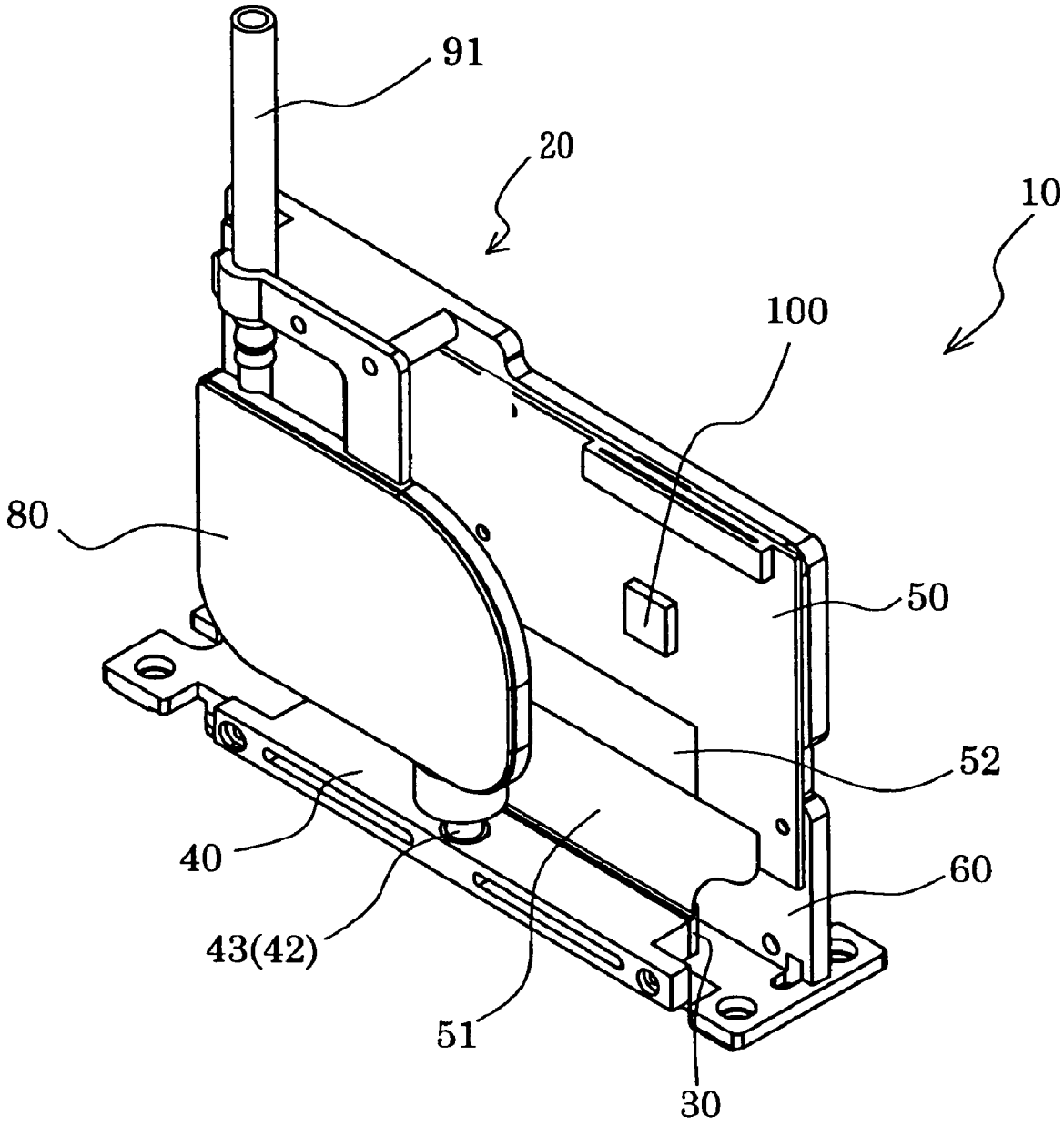
FIG. 2 is an exploded perspective view showing an ink-jet head according to an embodiment mode of the present invention.
Figure 3:
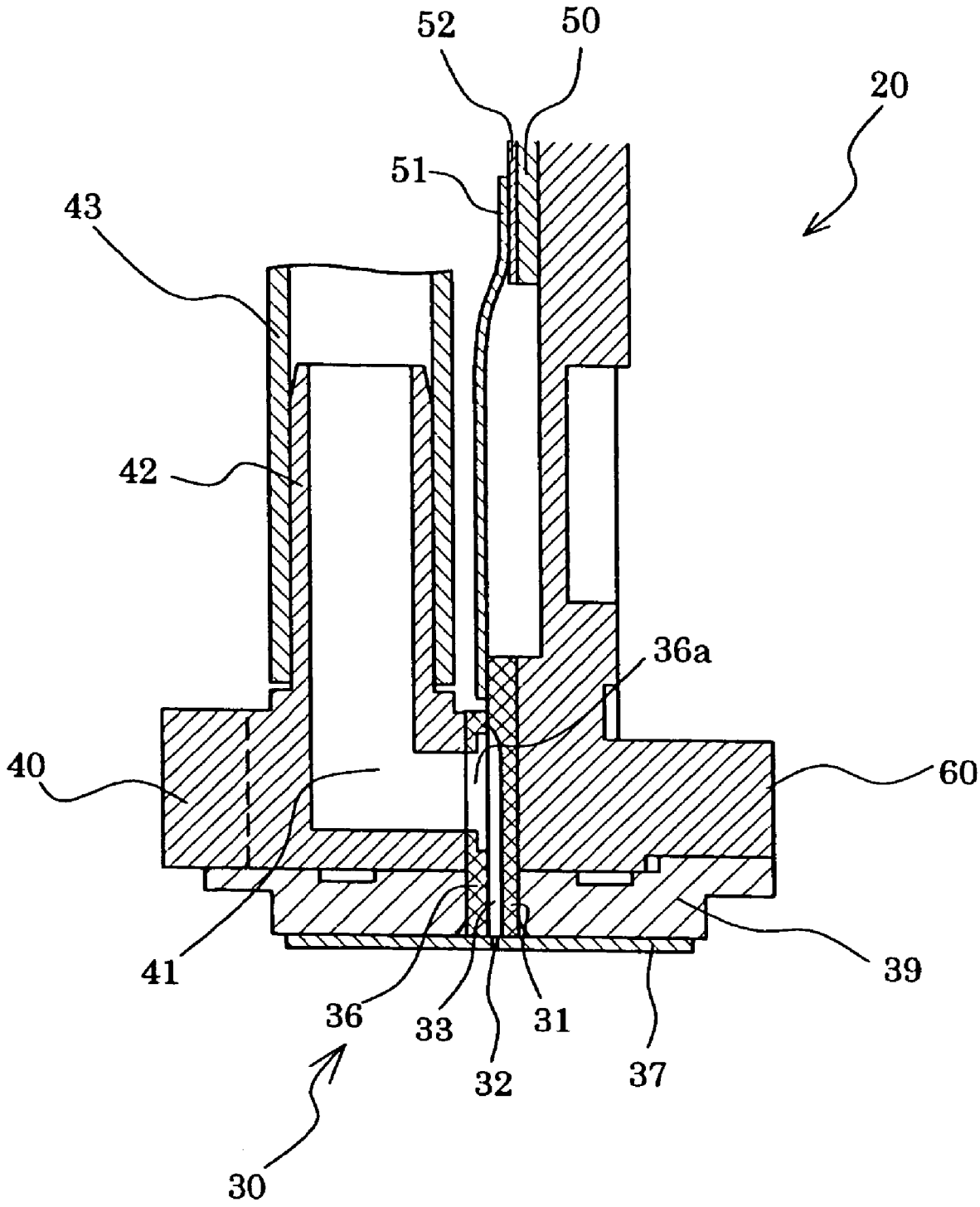
FIG. 3 is an exploded perspective view showing a head tip according to an embodiment mode of the present invention.
Figure 4A:
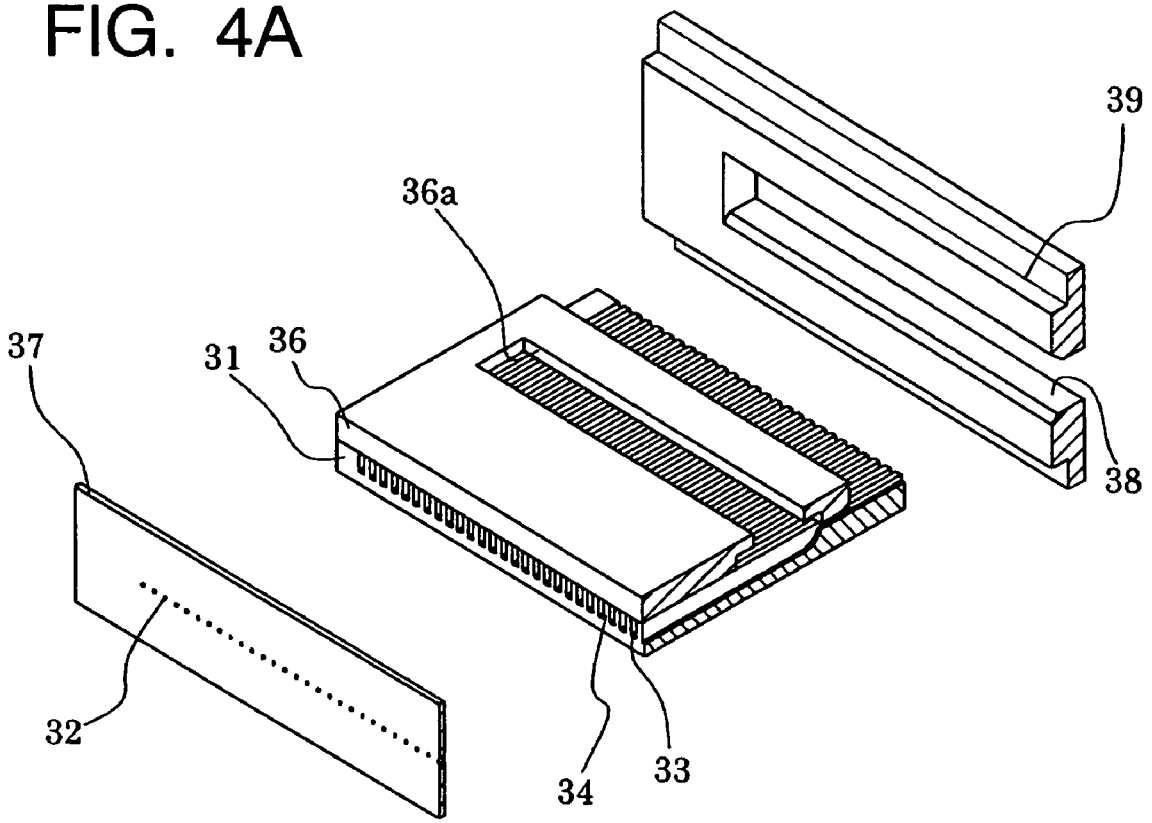
FIG. 4A–4B are a perspective view showing an assembly process of the ink-jet head according to an embodiment mode of the present invention.
Figure 4B:
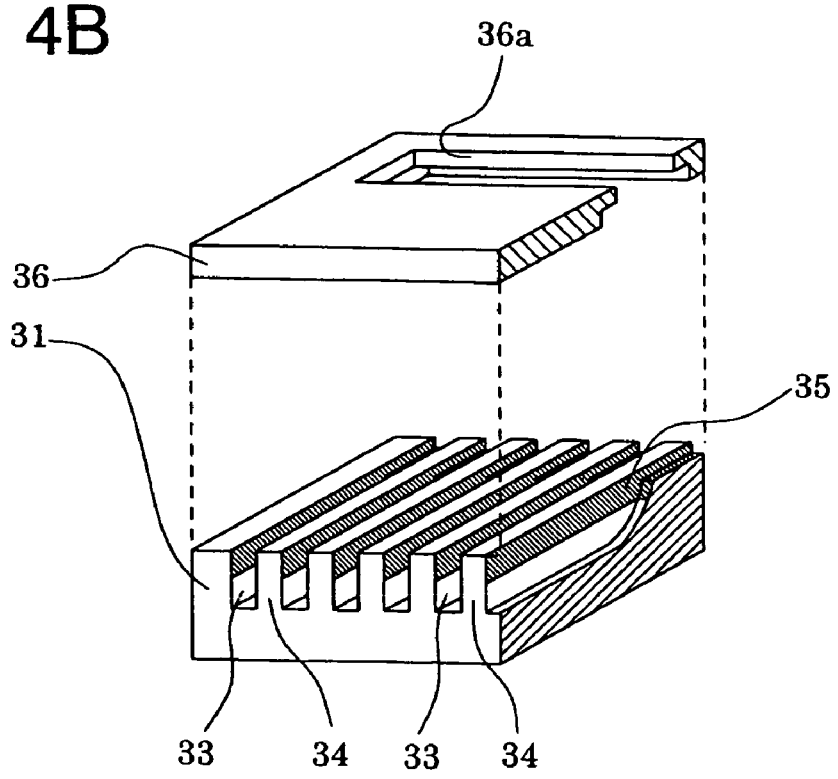

Here, the ink-jet heads mounted in the above-mentioned ink-jet type recording apparatus 10 will be described with reference to FIGS. 2 to 4. Note that FIG. 2 is a perspective view showing the ink-jet head according to this Embodiment, FIG. 3 is a main part sectional view showing the ink-jet head, and FIG. 4 is an exploded perspective view of a head tip and a perspective sectional view thereof.

As shown in the drawings, the ink-jet head 20 according to this Embodiment includes a head tip 30, a flow passage substrate 40 provided on one surface side thereof, and wiring substrate 50 on which a driver circuit for driving the head tip 30 and the like are mounted, and these respective parts are fixed to a base plate 60.

A plurality of grooves 33 communicating with nozzle openings 32 are arranged in a piezoelectric ceramic plate 31 constituting the head tip 30. Each groove 33 is isolated by side walls 34. One longitudinal end portion of each groove 33 extends to one end surface of the piezoelectric ceramic plate 31, the other end portion thereof does not extend to the other end surface, and the depth thereof gradually decreases. In addition, longitudinally extending electrodes 35 for drive electric field application are formed on the opening side of each groove 33 on the side walls 34 located on both sides of each groove 33 in a width direction thereof.

Each groove 33 formed in the piezoelectric ceramic plate 31 is formed by, for example, a disk-shaped dice cutter. Portions where the depth gradually decreases are formed in conformity with the configuration of the dice cutter. In addition, the electrodes 35 formed in each groove 33 are formed by, for example, known oblique evaporation.

One end of a flexible printed circuit (FPC) 51 is connected with the electrodes 35 provided on the opening sides of the side walls 34 located on both sides of each groove 33 and the other end of the FPC 51 is connected with a driver circuit 52 on the wiring substrate 50. Therefore, the electrodes 35 are electrically connected with the driver circuit 52.

Further, an ink chamber plate 36 is joined to the opening sides of the grooves 33 of the piezoelectric ceramic plate 31. A penetrated common ink chamber 36*a* is provided through the arranged grooves 33 in the ink chamber plate 36.

Note that the ink chamber plate 36 can be formed of a ceramic plate, a metal plate, or the like. Taking into account the deformation after its join to the piezoelectric ceramic plate 31, it is preferable to use a ceramic plate whose thermal expansion coefficient is approximate.

Also, a nozzle plate 37 is joined to the end surface of a joint unit which is composed of the piezoelectric ceramic plate 31 and the ink chamber plate 36 where the grooves 33 are open. The nozzle openings 32 are formed in the nozzle plate 37 at the positions opposed to the respective grooves 33.

In this Embodiment, the area of the nozzle plate 37 becomes larger than the area of the end surface of the joint unit which is composed of the piezoelectric ceramic plate 31 and the ink chamber plate 36 where the grooves 33 are open. This nozzle plate 37 is made of a polyimide film or the like, and the nozzle openings 32 are formed therein by using, for example, an excimer laser device. In addition, although not shown, a water-repellent film having water repellency for preventing adhesion of ink or the like is provided on the surface of the nozzle plate 37 opposing the object on which printing is to be performed.

Further, a nozzle support plate 39 in which an engaging hole 38 engaged with the joint unit is provided is joined to the peripheral surface of the joint unit which is composed of the piezoelectric ceramic plate 31 and the ink chamber plate 36 on the end surface side where the respective grooves 33 are open. Note that this nozzle support plate 39 is joined to a portion of the nozzle plate 37 outside the end surface of the joint unit to hold the nozzle plate 37 in a stable manner.

In the head tip 30 having such a structure, the surface of the piezoelectric ceramic plate 31 which is opposed to the ink chamber plate 36 is joined to the base plate 60 and fixed thereto. On the other hand, the flow passage substrate 40 is joined to one surface of the ink chamber plate 36.

Note that a connecting portion 42 which is provided so as to protrude along the base plate 60 and in which an ink supply path 41 is opened is provided to the surface of the flow passage substrate 40. The connecting portion 42 is connected with one end portion side of an ink communicating tube 43 made from a stainless tube or the like. The other end side of the ink communicating tube 43 is connected with, for example, an ink tank such as an ink cartridge through the ink supply tube 91, so that it is connected with an ink containing portion 80 that temporarily contains the predetermined amount of ink (see FIG. 1).

Here, drive means in which recording data is inputted to the driver circuit and a drive signal is outputted from the driver circuit to the pair of separate electrodes 35 provided to the side walls 34 of each chamber 33 will be described in detail. Note that FIG. 5 is an electrical circuit block diagram showing the ink-jet head 20.

Figure 5:
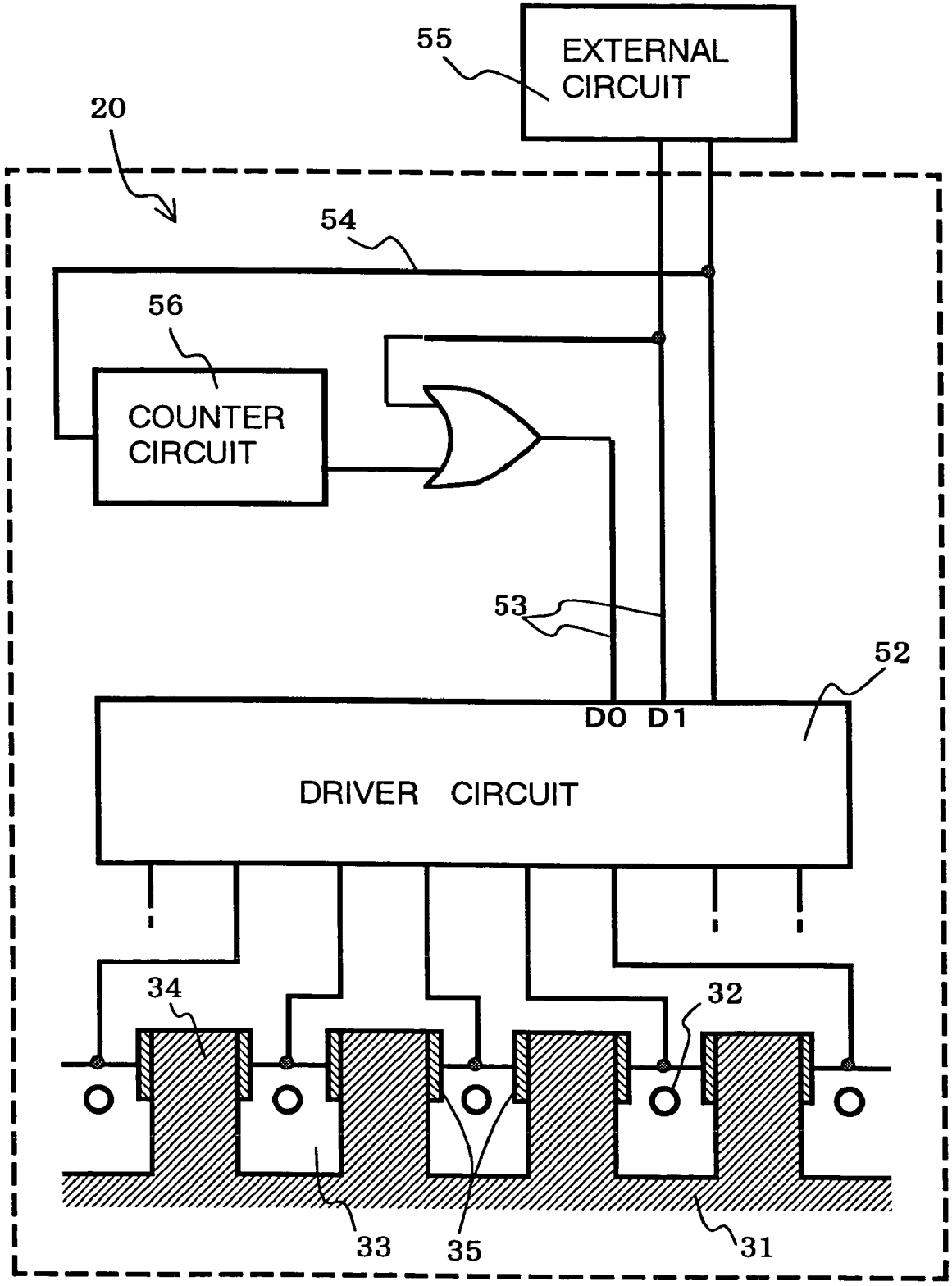
FIG. 5 is an electrical circuit block diagram showing the ink-jet head according to Embodiment Mode 1 of the present invention.

As shown in FIG. 5, recording data 53 corresponding to each chamber 33 is serially inputted to the driver circuit 52. After that, when an ejection timing signal 54 is inputted, a drive waveform is outputted to the electrodes 35.

The recording data 53 has data of 2-bit width. Any drive waveform of three drive waveforms described below is selected in accordance with a value of the data inputted to the driver circuit 52 and outputted from the driver circuit 52 to the separate electrodes 35. For example, when the value of the data 53 (D1, D0) inputted to the driver circuit 52 is "11", a first drive waveform for ejecting an ink droplet is selected and outputted to the separate electrodes 35. When the value of the data 53 (D1, D0) is "01", a second drive waveform for vibrating a meniscus to the extent to which the ink droplet is not ejected so that ink in the nozzle opening portion can be prevented from thickening is selected and outputted to the separate electrodes 35. When the value of the data 53 (D1, D0) is "00", a third drive waveform by which the meniscus is not vibrated and thus the ink droplet is not ejected is selected and outputted to the separate electrodes 35. Note that the right side of the 2-bit data is D0 and the left side thereof is D1.

The D0 signal of the recording data 53 is connected with recording data of 1-bit width from an external circuit 55 and with an output of a counter circuit 56 through an OR circuit. When output data from the external circuit 55 is "0" and the output of the counter circuit 56 is "1", the recording data 53 inputted to the driver circuit 52 becomes "01".

Here, the counter circuit 56 is a circuit that counts the number of ejection timing signals 54 inputted during printing and periodically outputs "11". In the case where this circuit is inserted, even when "0" data are successively inputted from the external circuit 55 during printing, the recording data 53 inputted to the driver circuit 52 periodically becomes "01", so that the ink can be prevented from thickening.

Note that, in this Embodiment, a drive waveform generating means is mainly constructed of the driver circuit 52, the counter circuit 56, and the OR circuit.

Figure 7A:
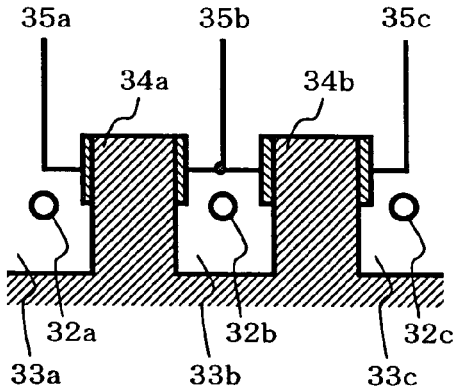
FIG. 7A–7D are a sectional view showing a piezoelectric ceramic plate according to an embodiment mode of the present invention and a diagram showing drive waveforms supplied to a pair of separate electrodes.

Here, the first to third drive waveforms will be described in detail. Note that FIG. 7A is a sectional view showing the piezoelectric ceramic plate in a chamber portion and FIGS. 7B to 7D show drive waveforms supplied to the separate electrodes 35.

Figure 7B:
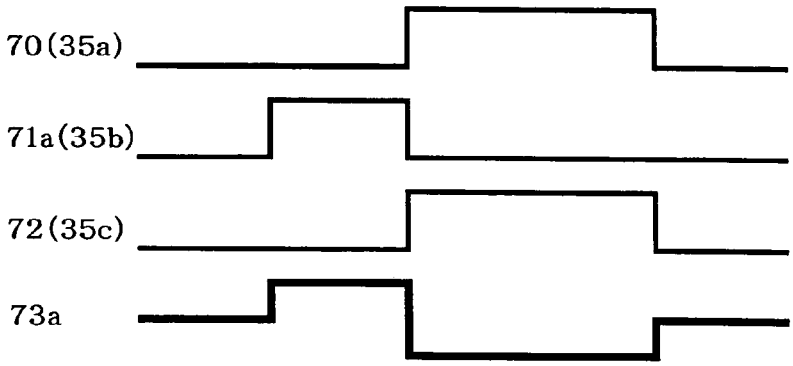
Figure 7C:
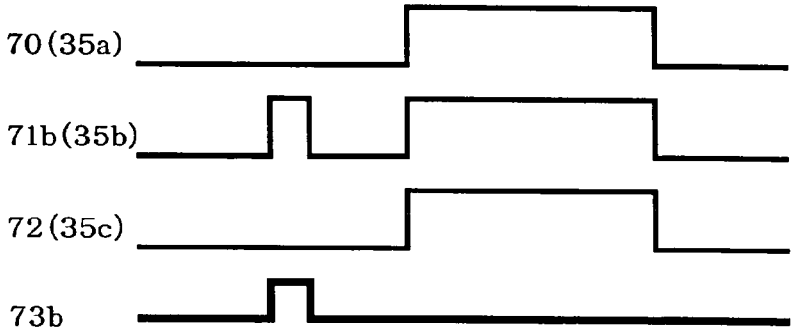
Figure 7D:
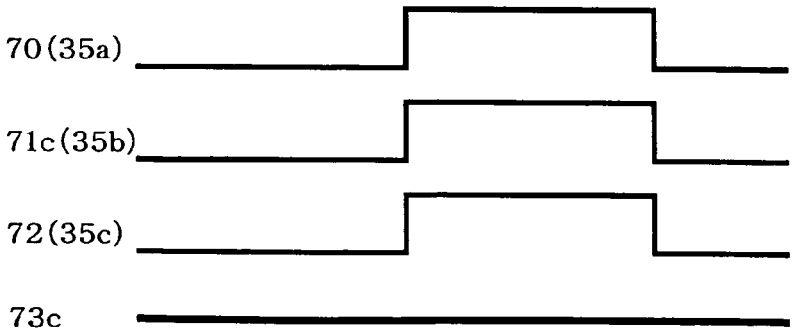
Figure 8:
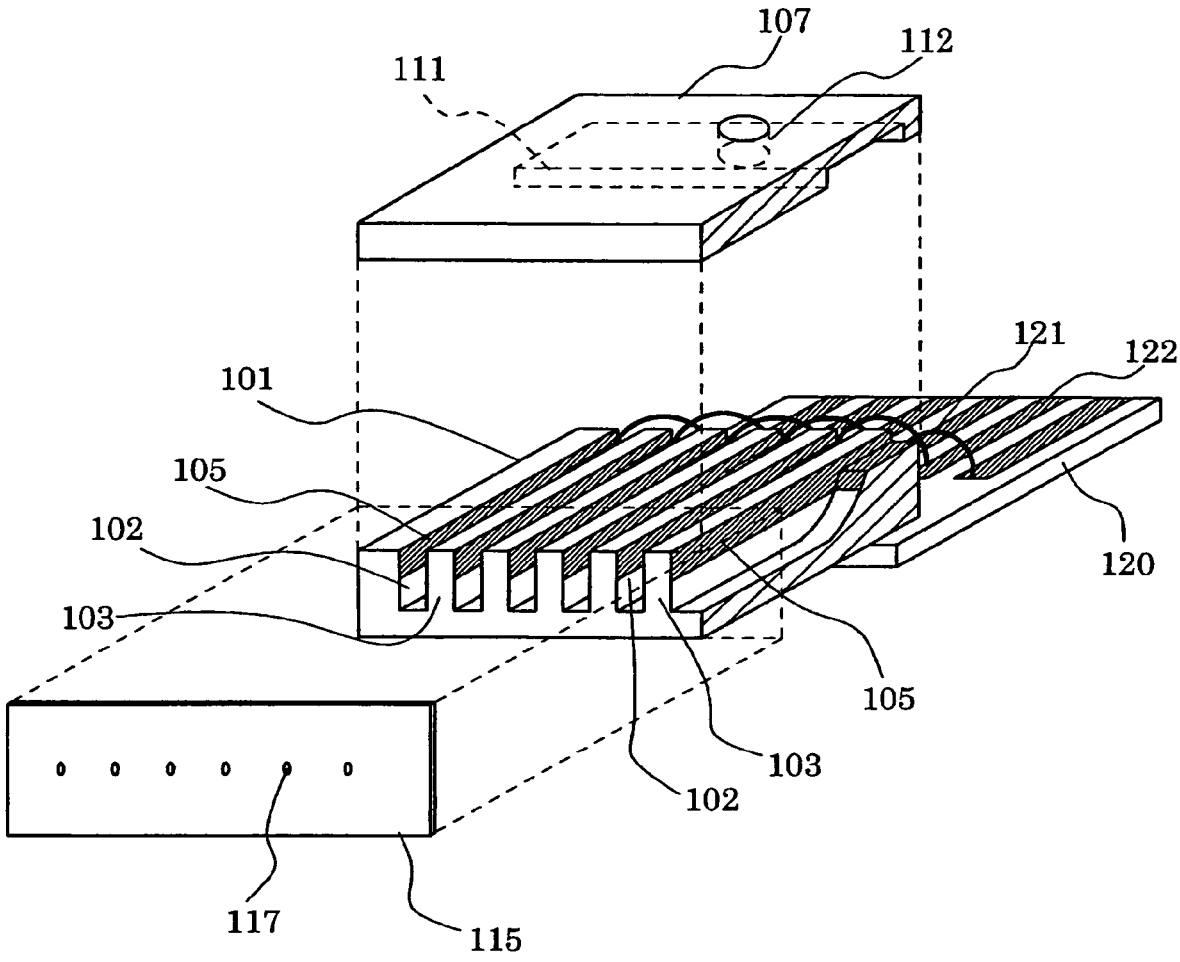
FIG. 8 is a schematic perspective view showing an outline of a head tip of an ink-jet head according to a conventional technique.
Figure 9A:
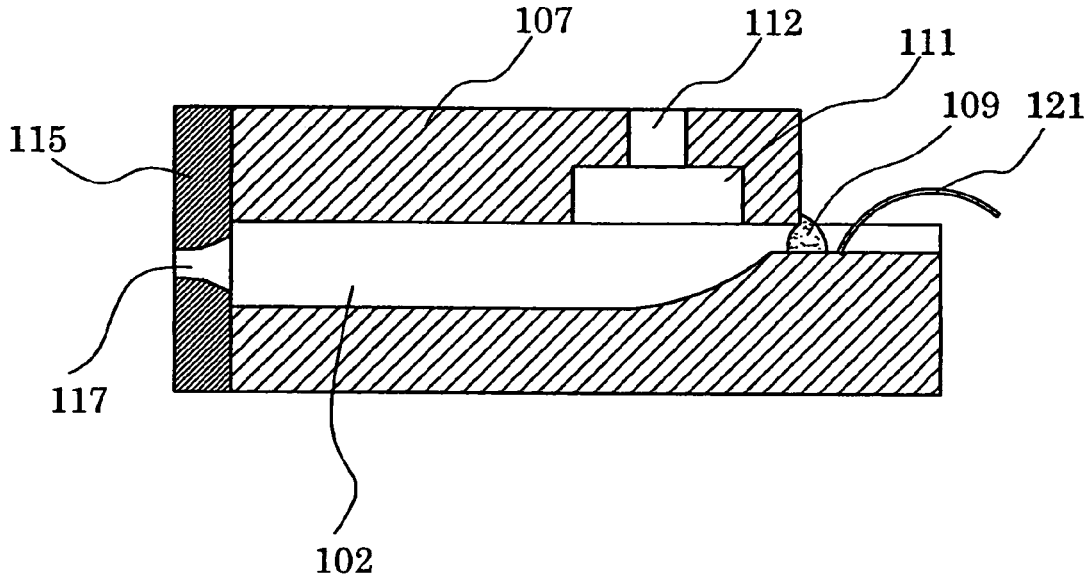
FIG. 9A PRIOR ART
FIG. 9A–9B are a sectional view showing the outline of the head tip of the ink-jet head according to the conventional technique.
Figure 9B:
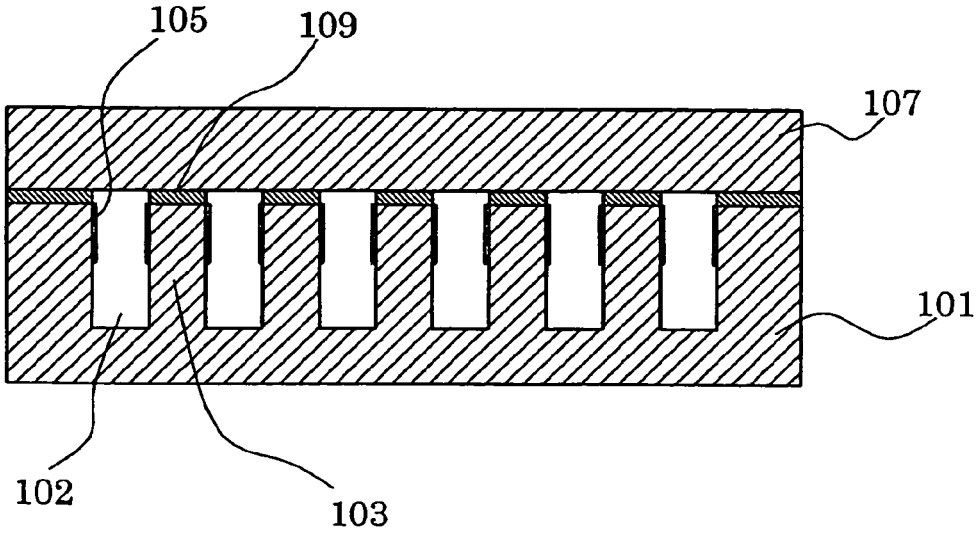
FIG. 9B PRIOR ART
Figure 10:
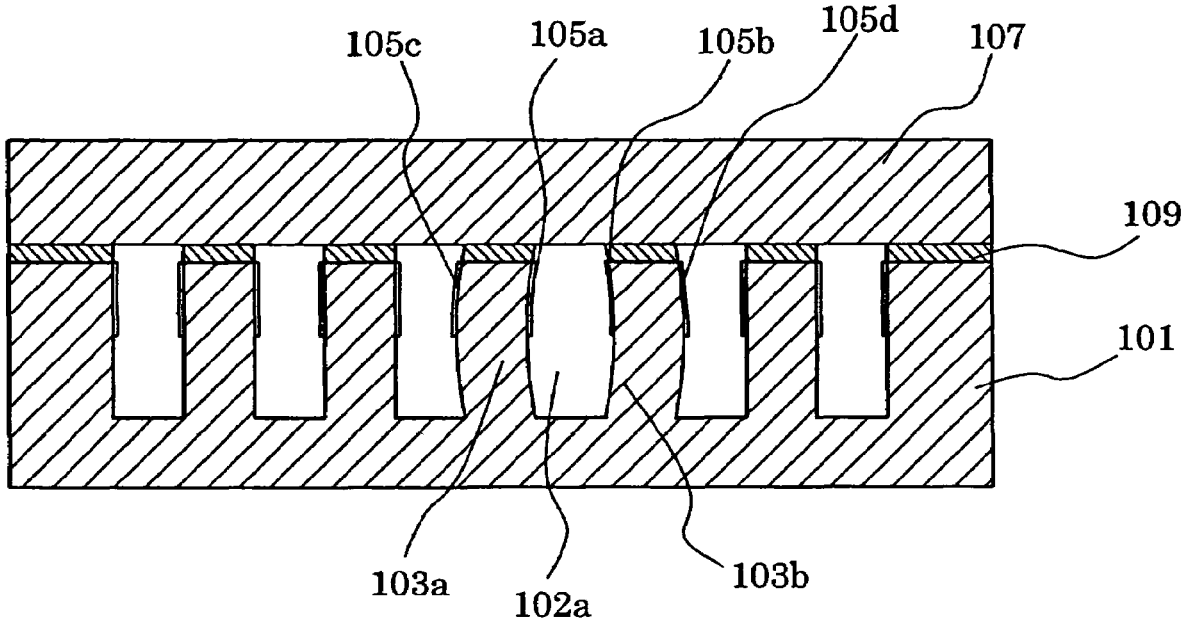
FIG. 10 PRIOR ART
FIG. 10 is a sectional view showing the outline of the head tip of the ink-jet head according to the conventional technique.

Drive waveforms 70 to 72 shown in FIGS. 7B to 7D indicate drive voltages applied to the pair of electrodes 35*a* to 35*c* in respective chambers 33*a* to 33*c*. A drive waveform 73 is a drive waveform indicating a drive electric field generated in the side walls 34*a* and 34*b* located on both sides of the chamber 33*b* based on the wave forms 70 to 72 indicating the drive voltages.

71*a* in FIG. 7B denotes the first drive waveform for ejecting the ink drop, 71*b* in FIG. 7C denotes the second drive waveform for vibrating a meniscus to the extent to which the ink droplet is not ejected so that ink in the nozzle opening portion can be prevented from thickening, and 71*c* in FIG. 7D denotes the third drive waveform by which the meniscus is not vibrated and thus the ink droplet is not ejected. The drive waveforms 70 and 72 supplied to outside electrodes 35*a* and 35*c* interposing the sidewalls of the corresponding chamber are the same as in FIGS. 7B to 7D. Drive electric fields 73*a* to 73*c* applied to the side walls 34*a* and 34*b* are changed according to the drive waveforms 71*a* to 71*c* supplied to the electrode 35*b* of the corresponding chamber.

With respect to the drive electric field 73*a* in FIG. 7B, there are a period for which the electric field is applied to the plus side to temporarily increase a volume of the chamber 33*b* and a period for which the electric field is applied to the minus side to temporarily decrease the volume of the chamber 33*b*. The ink droplet is ejected by a series of such operations. In the case of the drive electric field 73*b* in FIG. 7C, the electric field is applied to the plus side to temporarily increase the volume of the chamber 33*b*. Because of a short pulse width, a large change in pressure by which the ink is ejected is not caused. However, because the meniscus of the nozzle opening portion 32 vibrates, the thickened ink can be agitated. In the case of the drive electric field 73*c* in FIG. 7D, because the electric field is not applied, a change in pressure is not caused in the chamber 33*b*, so that the ink droplet is not ejected.

When the output data from the external circuit is "0", it is possible to always select the second drive waveform by which the ink can be prevented from thickening. However, according to a structure in this Embodiment, in consideration of deterioration due to the repetition of vibration of a piezoelectric ceramic, the second drive waveform is selected at regular intervals for which thickening of the ink is suppressed and the third drive waveform by which the piezoelectric ceramic is not vibrated is selected for the rest.

(Embodiment 2)

Figure 6:
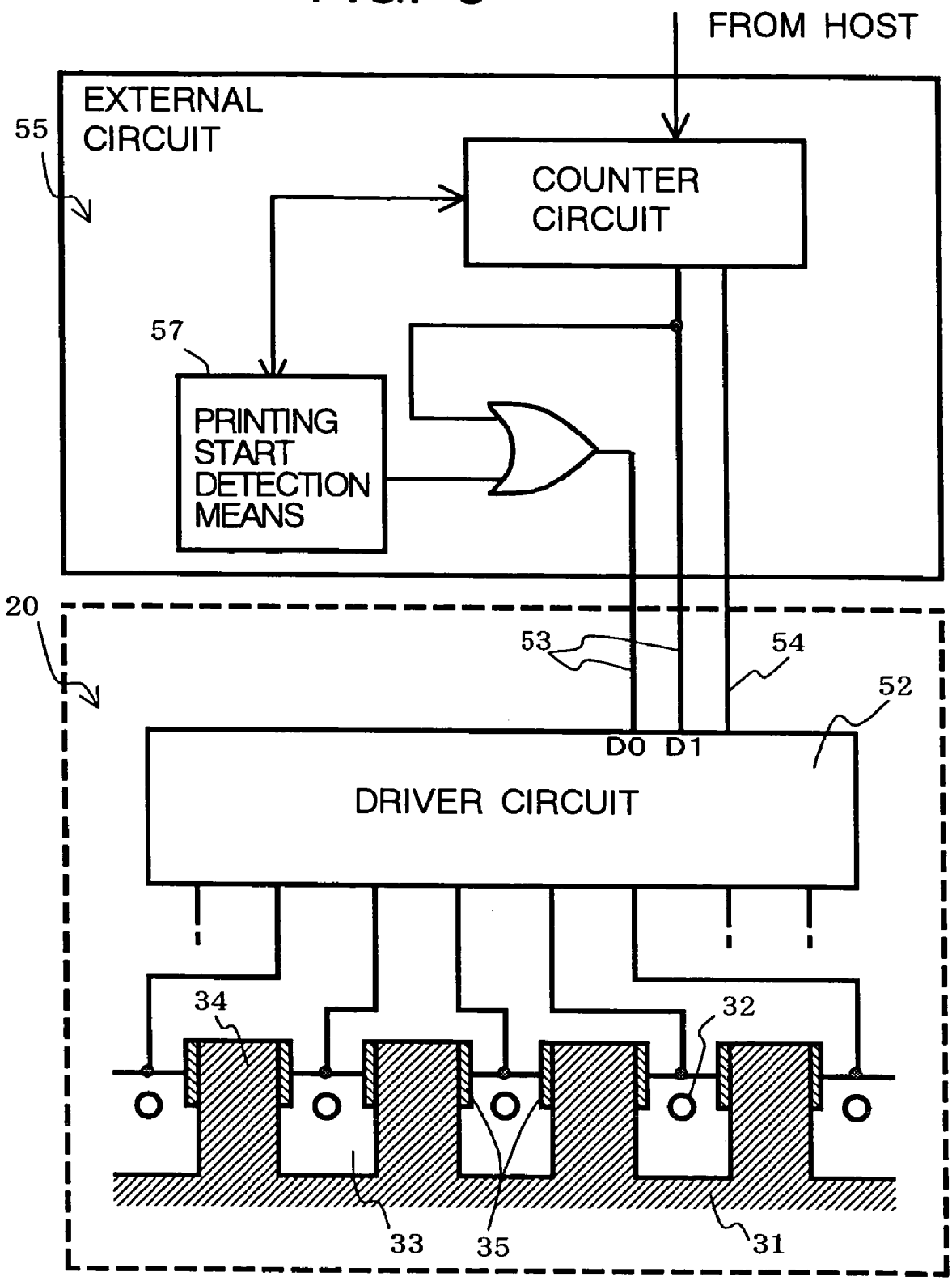
FIG. 6 is an electrical circuit block diagram showing an ink-jet head according to Embodiment Mode 2 of the present invention.

FIG. 6 is an electrical circuit block diagram for explaining recording data control of an ink-jet type recording apparatus according to Embodiment 2 of the present invention. Note that the same references are provided to the same parts as in Embodiment 1 described above and the duplicated description is omitted here.

As shown in FIG. 6, in the ink-jet type recording apparatus according to this Embodiment, printing start detection means 57 is provided instead of the counter circuit 56 and the printing start detection means 57 and the OR circuit are located inside the external circuit 55. A fundamental structure other than that is the same as in the ink-jet type recording apparatus according to Embodiment 1.

The recording data 53 has data of 2-bit width. Any drive waveform of three drive waveforms described below is selected in accordance with a value of the data inputted to the driver circuit 52 and outputted from the driver circuit 52 to the separate electrodes 35. For example, when the value of the data 53 (D1, D0) inputted to the driver circuit 52 is "11 ", the first drive waveform for ejecting the ink droplet is selected and outputted to the separate electrodes 35. When the value of the data 53 (D1, D0) is "01", the second drive waveform for vibrating the meniscus to the extent to which the ink droplet is not ejected so that ink in the nozzle opening portion can be prevented from thickening is selected and outputted to the separate electrodes 35. When the value of the data 53 (D1, D0) is "00", the third drive waveform by which the meniscus is not vibrated and thus the ink droplet is not ejected is selected and outputted to the separate electrodes 35. Note that the right side of the 2-bit data is D0 and the left side thereof is D1.

The D0 signal of the recording data 53 is connected with recording data of 1-bit width from control means and with an output of the printing start detection means 57 through the OR circuit. When output data from the control means is "0" and the output of the printing start detection means 57 is "1", the recording data 53 inputted to the driver circuit 52 becomes "01".

Here, the printing start detection means 57 is constructed such that the output thereof becomes "1" in accordance with information from the control means immediately before printing starts, so that the recording data becomes "01" immediately before printing starts. Therefore, the meniscus can be vibrated to the extent to which the ejection is not performed immediately before printing starts. Thus, the ink can be prevented from thickening, so that a preferable printing result is obtained.

Note that, in this Embodiment, the drive waveform generating means is mainly constructed of the driver circuit 52, the printing start detection means 57, the control means, and the OR circuit.

(Other Embodiments)

Note that, in the embodiments, the 2-bit width is used for the recording data 53 inputted to the driver circuit 52. However, the present invention may be used for a multi-level ink-jet type recording apparatus which has the amount of data equal to or larger than three bits and performs printing while the amount of ink to be dropped changes. In addition, the counter circuit 56 is located inside the ink-jet head 20 in Embodiment 1 of the present invention and the printing start detection means 57 is located inside the external circuit 55 in Embodiment 2 of the present invention. However, these circuits may be located inside any of the ink-jet head 20 and the external circuit 55.

As described above, according to the ink-jet type recording apparatus and the ink-jet type recording method in the present invention, upon selection of one waveform from among the first drive waveform for ejecting the ink droplet based on the recording data, the second drive waveform for vibrating the meniscus to the extent to which the ink droplet is not ejected so that the ink in the nozzle opening portion can be prevented from thickening, and the third drive waveform by which the meniscus is not vibrated and thus the ink droplet is not ejected, the drive waveform is supplied to the separate electrodes. Therefore, even during the printing operation, the meniscus can be vibrated to the extent to which the ejection is not performed on an arbitrary nozzle, and a nozzle in which the meniscus is vibrated to the extent to which the ejection is not performed can be easily specified.

In addition, the second drive waveform is supplied at regular intervals to the nozzle in which the ejection is not performed. Therefore, unnecessary vibration to the piezoelectric ceramic can be suppressed and an effect of extending the life of the head can be obtained.

Also, the second drive waveform by which the ink can be prevented from thickening is supplied at the same voltage amplitude as the first drive waveform for ejecting the ink droplet and with a pulse width shorter than that, so that the complicated voltage control is unnecessary.

Also, the recording data has the amount of information equal to or larger than at least two bits and using one bit of them, one of the waveforms can be selected from the second drive waveform by which the ink can be prevented from thickening and the third drive waveform by which the meniscus is not vibrated and thus the ink droplet is not ejected. Therefore, the meniscus can be vibrated at regular intervals by the addition of the simple counter circuit.

Also, the second drive waveform by which the ink can be prevented from thickening is supplied immediately before printing starts. Thus, preferable printing is obtained from immediately after printing starts.

What is claimed is:

1. An ink-jet head comprising:

a plurality of chambers each communicating with a nozzle opening and being supplied with ink, the chambers being arranged side by side in a piezoelectric ceramic plate;

electrodes provided on both side walls of each of the chambers for supplying a voltage drive waveform to generate a drive electric field in the side walls for ejecting ink; and drive waveform generating means for selecting any one of a first drive waveform for ejecting an ink droplet from a nozzle opening and a second drive waveform for vibrating a meniscus of the ink to an extent that no ink droplet is ejected from the nozzle opening, based on recording data related to printing outputted from an external circuit, and outputting a voltage drive waveform to the electrodes, the drive waveform grenerating means comprising a driver circuit that outputs a drive waveform to the electrodes, a counter circuit that counts the number of ejection timing signals for controlling ink election from the nozzle opening, and an OR circuit that computes a logical OR of the recording data related to printing which is outputted from the external circuit and data outputted from the counter circuit and outputs a result to the driver circuit.

2. An ink-jet head according to claim 1, wherein the drive waveform generating means selects one drive waveform from among the first drive waveform, the second drive waveform, and a third drive waveform by which the meniscus in the nozzle opening is not vibrated, based on the recording data, and outputs a voltage drive waveform to the electrodes.

3. An ink-jet head according to claim 2, wherein the recording data for each of the chambers has an amount of information equal to or larger than at least two bits, and one of the second drive waveform an the third drive waveform can be selected using one bit which is smaller than the amount of information.

4. An ink-jet head according to claim 3, wherein one of the second drive waveform and the third drive waveform can be selected using one bit of the recording data.

5. An ink-jet head according to claim 1, wherein the second drive waveform has a voltage amplitude equal to the first drive waveform and a pulse width shorter than the first drive waveform.

6. An ink-jet head according to claim 1, wherein the second drive waveform is supplied to the electrodes immediately before printing starts.

7. An ink-jet head according to claim 1, further comprising a counter circuit that counts the number of ejection timing signals for controlling ink ejection from the nozzle openings, wherein the second drive waveform is supplied to the electrodes periodically every predetermined number of counts of the counter circuit.

8. An ink-jet type recording apparatus comprising the ink-jet head according to claim 1.

* * * * *